US009130317B2

(12) United States Patent
Wang et al.

(10) Patent No.: US 9,130,317 B2
(45) Date of Patent: Sep. 8, 2015

(54) CONNECTOR ASSEMBLY

(71) Applicants: Hsin-Chieh Wang, New Taipei (TW); Wei-Chu Chen, New Taipei (TW); Yuan-Hsiang Shen, New Taipei (TW); Hsiao-Wei Liu, New Taipei (TW); Yu-Min Cheng, New Taipei (TW); Yen-Ching Su, New Taipei (TW); Huei-Che Yu, New Taipei (TW); Bor-Chen Tsai, New Taipei (TW)

(72) Inventors: Hsin-Chieh Wang, New Taipei (TW); Wei-Chu Chen, New Taipei (TW); Yuan-Hsiang Shen, New Taipei (TW); Hsiao-Wei Liu, New Taipei (TW); Yu-Min Cheng, New Taipei (TW); Yen-Ching Su, New Taipei (TW); Huei-Che Yu, New Taipei (TW); Bor-Chen Tsai, New Taipei (TW)

(73) Assignee: C.C.P. Contact Probes Co., Ltd., Banqiao Dist., New Taipei (TW)

( * ) Notice: Subject to any disclaimer, the term of this patent is extended or adjusted under 35 U.S.C. 154(b) by 0 days.

(21) Appl. No.: 14/162,722

(22) Filed: Jan. 23, 2014

(65) Prior Publication Data

US 2015/0017831 A1 Jan. 15, 2015

(30) Foreign Application Priority Data

Jul. 12, 2013 (TW) ..... 102125068 A

(51) Int. Cl.

| | |
|---|---|
| ***H01R 13/66*** | (2006.01) |
| ***H01R 13/62*** | (2006.01) |
| *H01R 13/24* | (2006.01) |
| *H01R 13/703* | (2006.01) |

(52) U.S. Cl.

CPC ..... *H01R 13/6683* (2013.01); *H01R 13/6205* (2013.01); *H01R 13/2421* (2013.01); *H01R 13/7037* (2013.01)

(58) Field of Classification Search

CPC ..... H01R 13/6683; H01R 13/2421; H01R 13/7037

USPC ..... 439/700, 824

See application file for complete search history.

(56) References Cited

U.S. PATENT DOCUMENTS

| | | | | | |
|---|---|---|---|---|---|
| 2,573,920 | A * | 11/1951 | McLeod | ..... | 200/51.09 |
| 3,159,725 | A * | 12/1964 | Dennis | ..... | 200/51.09 |
| 4,242,657 | A * | 12/1980 | Chaillot | ..... | 335/207 |
| 4,647,120 | A * | 3/1987 | Karabakakis | ..... | 439/39 |
| 5,244,396 | A * | 9/1993 | Matsuoka | ..... | 439/72 |
| 5,324,205 | A * | 6/1994 | Ahmad et al. | ..... | 439/66 |
| 5,938,451 | A * | 8/1999 | Rathburn | ..... | 439/66 |
| 5,947,749 | A * | 9/1999 | Rathburn | ..... | 439/66 |
| 6,312,295 | B2 * | 11/2001 | Nishimatsu | ..... | 439/700 |
| 6,524,140 | B2 * | 2/2003 | Takagi et al. | ..... | 439/700 |
| 6,623,316 | B1 * | 9/2003 | Wu | ..... | 439/862 |
| 6,729,890 | B2 * | 5/2004 | Shin | ..... | 439/74 |
| 6,758,682 | B1 * | 7/2004 | Kosmala | ..... | 439/66 |
| 6,776,624 | B2 * | 8/2004 | Suematsu | ..... | 439/71 |

(Continued)

*Primary Examiner* — Ross Gushi

(74) *Attorney, Agent, or Firm* — Winston Hsu; Scott Margo

(57) ABSTRACT

A connector assembly includes a first connector and a second connector. The first connector is coupled to a first electronic device, and the second connector is coupled to a second electronic device and detachably mated with the first connector. The first connector includes a first housing and a magnetic member. The magnetic member is installed inside the first housing and for generating magnetic field. The second connector includes a second housing and a magnetic sensor disposed in the second housing. The magnetic sensor senses the magnetic field generated by the magnetic member when the second connector is mated with the first connector, so as to drive the second electronic device to power the first electronic device.

17 Claims, 13 Drawing Sheets

(56) References Cited

U.S. PATENT DOCUMENTS

| | | | | |
|---|---|---|---|---|
| 6,814,585 | B2 * | 11/2004 | Bedell et al. | 439/66 |
| 6,854,981 | B2 * | 2/2005 | Nelson | 439/66 |
| 6,935,901 | B2 * | 8/2005 | Simpson et al. | 439/700 |
| 6,935,906 | B2 * | 8/2005 | Orihara | 439/824 |
| 6,981,881 | B2 * | 1/2006 | Adachi et al. | 439/71 |
| 7,081,025 | B2 * | 7/2006 | Zhang et al. | 439/700 |
| 7,114,973 | B2 * | 10/2006 | Haggerty | 439/246 |
| 7,144,278 | B2 * | 12/2006 | Le Gallic et al. | 439/700 |
| 7,165,975 | B2 * | 1/2007 | Hasegawa et al. | 439/66 |
| 7,326,064 | B2 * | 2/2008 | Rathburn et al. | 439/66 |
| 7,338,293 | B2 * | 3/2008 | Gilk | 439/66 |
| 7,467,948 | B2 * | 12/2008 | Lindberg et al. | 439/38 |
| 7,479,794 | B2 * | 1/2009 | Chartarifsky et al. | 324/755.05 |
| 7,507,110 | B1 * | 3/2009 | Yin et al. | 439/482 |
| 7,625,216 | B2 * | 12/2009 | Mendenhall et al. | 439/66 |
| 7,632,106 | B2 * | 12/2009 | Nakamura | 439/66 |
| 7,637,746 | B2 * | 12/2009 | Lindberg et al. | 439/38 |
| 7,645,164 | B1 * | 1/2010 | Ju | 439/591 |
| 7,695,286 | B2 * | 4/2010 | Swart et al. | 439/66 |
| 7,891,983 | B2 * | 2/2011 | Ichimura et al. | 439/66 |
| 8,197,290 | B2 * | 6/2012 | Koyama et al. | 439/862 |
| 8,251,755 | B2 * | 8/2012 | Mulfinger et al. | 439/700 |
| 8,272,903 | B2 * | 9/2012 | Lin | 439/700 |
| 8,324,919 | B2 * | 12/2012 | Chabineau-Lovgren et al. | 324/755.11 |
| 8,536,889 | B2 * | 9/2013 | Nelson et al. | 324/754.01 |
| 8,556,667 | B2 * | 10/2013 | Koyama et al. | 439/862 |
| 8,657,635 | B2 * | 2/2014 | Koyama et al. | 439/862 |
| 8,723,542 | B2 * | 5/2014 | Lin | 324/755.05 |
| 8,734,189 | B2 * | 5/2014 | Kim | 439/700 |
| 8,734,193 | B2 * | 5/2014 | Tokuhara et al. | 439/824 |
| 8,758,067 | B2 * | 6/2014 | Rathburn | 439/700 |
| 8,764,472 | B2 * | 7/2014 | Rassoolkhani et al. | 439/347 |
| 8,784,145 | B2 * | 7/2014 | Koyama et al. | 439/862 |
| 8,790,139 | B2 * | 7/2014 | Fitzpatrick | 439/676 |
| 8,905,795 | B2 * | 12/2014 | Kim et al. | 439/700 |
| 8,937,484 | B2 * | 1/2015 | Nelson et al. | 324/754.01 |
| 2001/0012718 | A1 * | 8/2001 | Nishimatsu | 439/378 |
| 2003/0104731 | A1 * | 6/2003 | Chang | 439/862 |
| 2003/0124893 | A1 * | 7/2003 | Campbell | 439/188 |
| 2004/0077225 | A1 * | 4/2004 | Chun-Fu | 439/700 |
| 2005/0042938 | A1 * | 2/2005 | Zheng et al. | 439/824 |
| 2005/0064765 | A1 * | 3/2005 | Simpson et al. | 439/700 |
| 2005/0070170 | A1 * | 3/2005 | Zhang et al. | 439/700 |
| 2005/0070173 | A1 * | 3/2005 | Zheng et al. | 439/824 |
| 2005/0215126 | A1 * | 9/2005 | Haggerty | 439/700 |
| 2007/0093145 | A1 * | 4/2007 | Wei | 439/824 |
| 2007/0149013 | A1 * | 6/2007 | Eastham et al. | 439/140 |
| 2007/0232152 | A1 * | 10/2007 | Hong | 439/700 |
| 2007/0236236 | A1 * | 10/2007 | Shell et al. | 324/763 |
| 2008/0182436 | A1 * | 7/2008 | Rathburn | 439/78 |
| 2009/0053912 | A1 * | 2/2009 | Lopez et al. | 439/72 |
| 2009/0197475 | A1 * | 8/2009 | Guo et al. | 439/688 |
| 2010/0203770 | A1 * | 8/2010 | Hirai | 439/700 |
| 2011/0111643 | A1 * | 5/2011 | Yin et al. | 439/668 |
| 2011/0148650 | A1 * | 6/2011 | Jenkins et al. | 340/686.6 |
| 2011/0153739 | A1 * | 6/2011 | McCoy | 709/204 |
| 2011/0250785 | A1 * | 10/2011 | Reid | 439/488 |
| 2011/0306251 | A1 * | 12/2011 | Mulfinger et al. | 439/733.1 |
| 2012/0075793 | A1 * | 3/2012 | Chien et al. | 361/679.41 |
| 2012/0108111 | A1 * | 5/2012 | Koyama et al. | 439/746 |
| 2012/0171905 | A1 * | 7/2012 | Koyama et al. | 439/676 |
| 2012/0238141 | A1 * | 9/2012 | Koyama et al. | 439/625 |
| 2013/0027054 | A1 * | 1/2013 | Mackey et al. | 324/538 |
| 2013/0095690 | A1 * | 4/2013 | Kim et al. | 439/370 |
| 2013/0162053 | A1 * | 6/2013 | Iizuka et al. | 307/140 |
| 2013/0337673 | A1 * | 12/2013 | King et al. | 439/188 |
| 2014/0057500 | A1 * | 2/2014 | Morinari | 439/700 |
| 2014/0273608 | A1 * | 9/2014 | Whetstone et al. | 439/488 |
| 2014/0302691 | A1 * | 10/2014 | Janfada et al. | 439/39 |
| 2015/0017831 | A1 * | 1/2015 | Wang et al. | 439/488 |

* cited by examiner

CONNECTOR ASSEMBLY

BACKGROUND OF THE INVENTION

1. Field of the Invention

The present invention relates to a connector assembly, and more particularly, to a connector assembly capable of preventing arcing during mating process.

2. Description of the Prior Art

Recently, a connector with pogo pin has been implemented in a power plug coupled to a cable, wherein the power plug is used for mating with a power receptacle fixed on a notebook computer. When the power plug coupled to the cable is mated with the power receptacle on the notebook computer, the notebook computer can be charged or electrified for a user to operate, such as typing, playing video and so on. However, when long term use, the resistance between the power plug and the power receptacle will increase due to oxidation of the contacting surface of the pogo pin. As a result, the plug contact and the receptacle contact may be overheated during the mating process and further it will generate arcing and thus result in safety issue.

SUMMARY OF THE INVENTION

Thus, the present invention provides a connector assembly capable of preventing arcing during mating process for solving above drawbacks.

According to an embodiment of the present invention, a connector assembly includes a first connector and a second connector. The first connector is coupled to a first electronic device, and the second connector is coupled to a second electronic device and detachably mated with the first connector. The first connector includes a first housing and a magnetic member, and the magnetic member is installed inside the first housing and for generating magnetic field. The second connector includes a second housing and a magnetic sensor. The magnetic sensor is disposed in the second housing, and the magnetic sensor senses the magnetic field generated by the magnetic member when the second connector mates with the first connector, so as to drive the second electronic device to power the first electronic device.

According to another embodiment of the present invention, the first connector further includes a first contact set fixed inside the first housing. Each of the first contacts has a contacting surface, and a normal of the contacting surface is not parallel to a mating direction. The second connector further includes a second contact set fixed inside the second housing. An end of each of the second contacts contacts the contacting surface of the corresponding first contact and slides along the contacting surface from a first contact position to a second contact position when the second connector mates with the first connector along the mating direction.

In summary, the present invention adopts a design that the normal of the contacting surface of each of the first contacts is not parallel to the mating direction to allow the end of each of the second contacts of the second contact set to contact the contacting surface of the corresponding first contact when the second connector is inserted into the first connector along the mating direction, such that the end of the second contact slides from the first contact position to the second contact position. Accordingly, the oxidation layers on the end of the second contact and on the contacting surface of the first contact resulting from long term use will be scratched by the aforesaid sliding mechanism, so as to reduce resistance between the first contact and the second contact. In such a manner, the structure of the inclined surface adopted by the contacting surface of the first contact of the present invention not only prevents the first contact and the second contact from being overheated due to a large resistance, but also prevents the first contact and the second contact from arcing due to overheat when the first contact and the second contact are electrified, so as to enhance safety of the first connector and the second connector in use.

In addition, the present invention utilizes the control unit for driving the second electronic device to power the first electronic device when the magnetic sensor senses the magnetic field generated by the magnetic member, so as to confirm that current passes between the end of the second contact and the contacting surface of the first contact only when the end of the second contact slides along the contacting surface of the first contact from the first contact position to the second contact position. In such a manner, the present invention ensures that there will be no current passing between the end of the second contact and the contacting surface of the first contact before the oxidation on the end of the second contact and on the contacting surface of the first contact due to long term use is not scratched. Furthermore, it prevents the first contact and the second contact from being overheated due to the large resistance, as being electrified and to enhance the safety of the first connector and the second connector in use.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the embodiments, reference is made to the accompanying drawings which form a part hereof, and in which is shown by way of illustration specific embodiments in which the invention may be practiced. In this regard, directional terminology, such as "top," "bottom," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," and "installed" and variations thereof herein are used broadly and encompass direct and indirect connections and installations. Accordingly, the drawings and descriptions will be regarded as illustrative in nature and not as restrictive.

Figure 1:
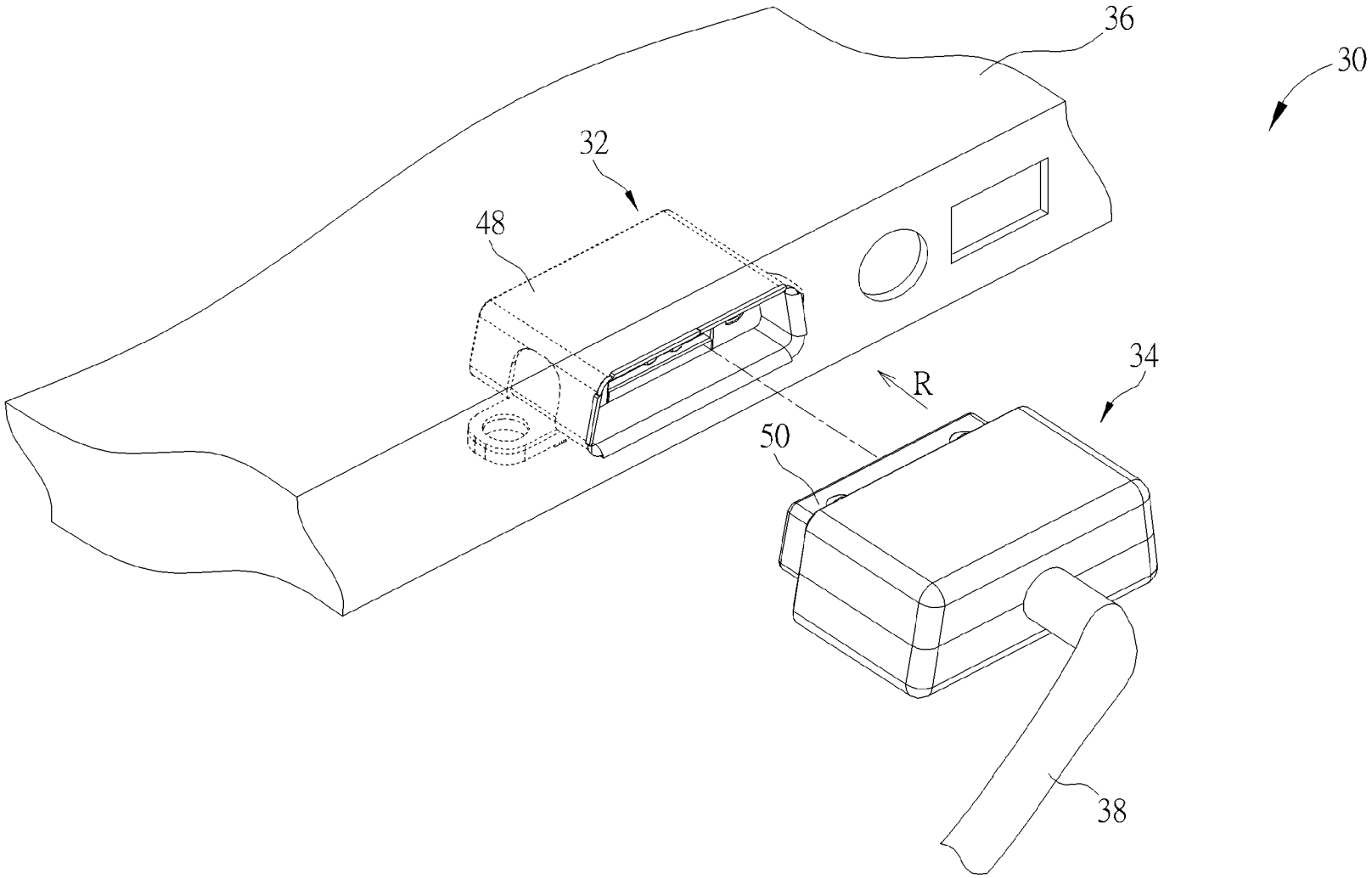
FIG. 1 is a diagram of a connector assembly according to an embodiment of the present invention.

Please refer to FIG. 1. FIG. 1 is a diagram of a connector assembly 30 according to an embodiment of the present invention. As shown in FIG. 1, the connector assembly 30 includes a first connector 32 and a second connector 34. The first connector 32 is coupled to a first electronic device 36, and the second connector 34 is coupled to a second electronic device 38 and detachably mated with the first connector 32. In this embodiment, the first electronic device 36 is a notebook computer, and the first connector 32 is a power receptacle of the notebook computer. The second electronic device 38 is a cable, and the second connector 34 is a power plug of the cable for mating with the power receptacle. Furthermore, the other end of the second electronic device 38 opposite to the second connector 34 has a plug (not shown in figures), and the plug is for coupling to an external power supply. Accordingly, when the first connector 32 is mated with the second connector 34, the external power supply charges the first electronic device 36, or alternatively, the external power supply electrifies the first electronic device 36 for a user to perform operations, such as typing, playing video and so on, on the first electronic device 36.

Figure 2:
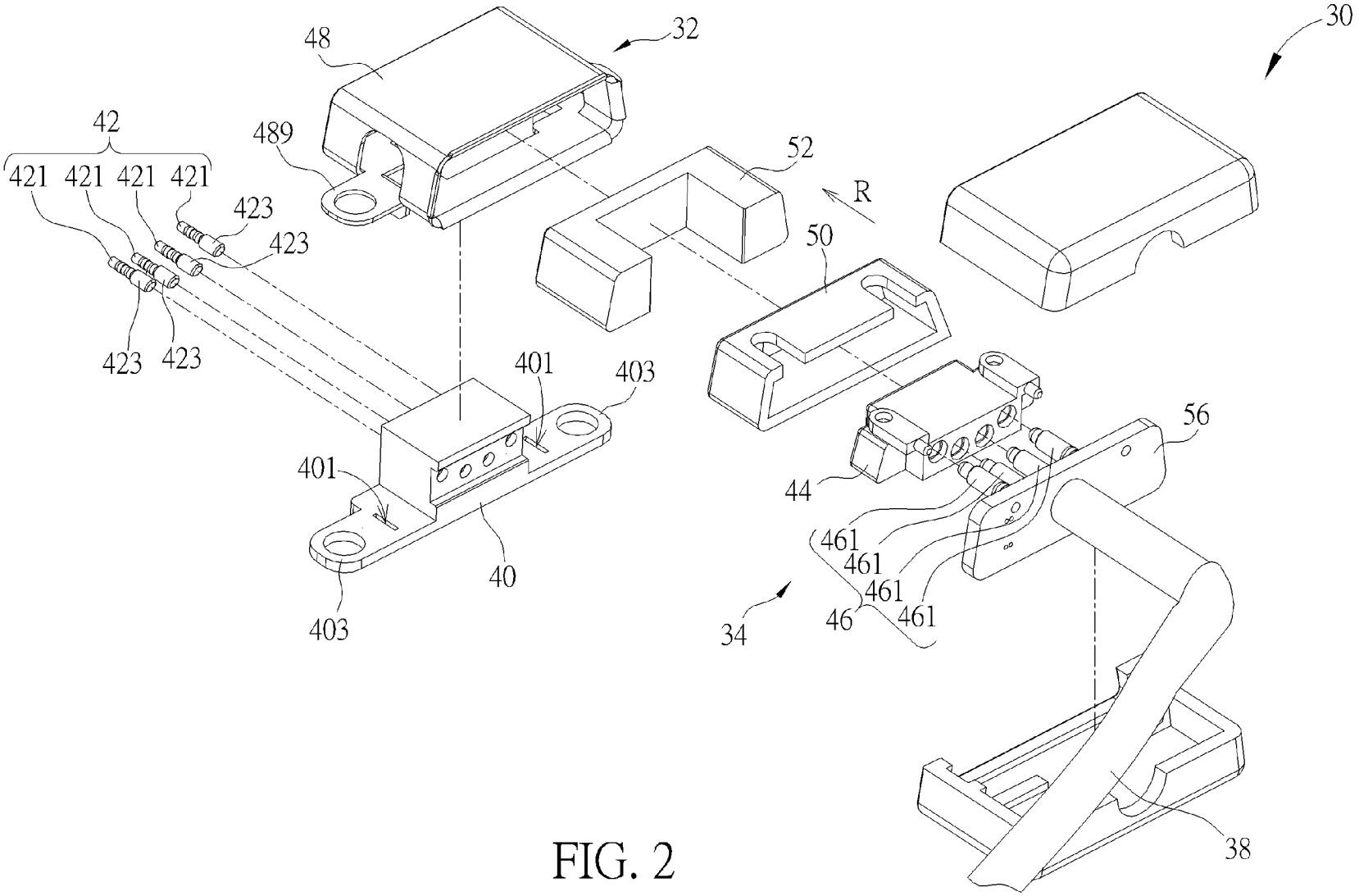
FIG. 2 is an exploded diagram of the connector assembly according to the embodiment of the present invention.
Figure 3:
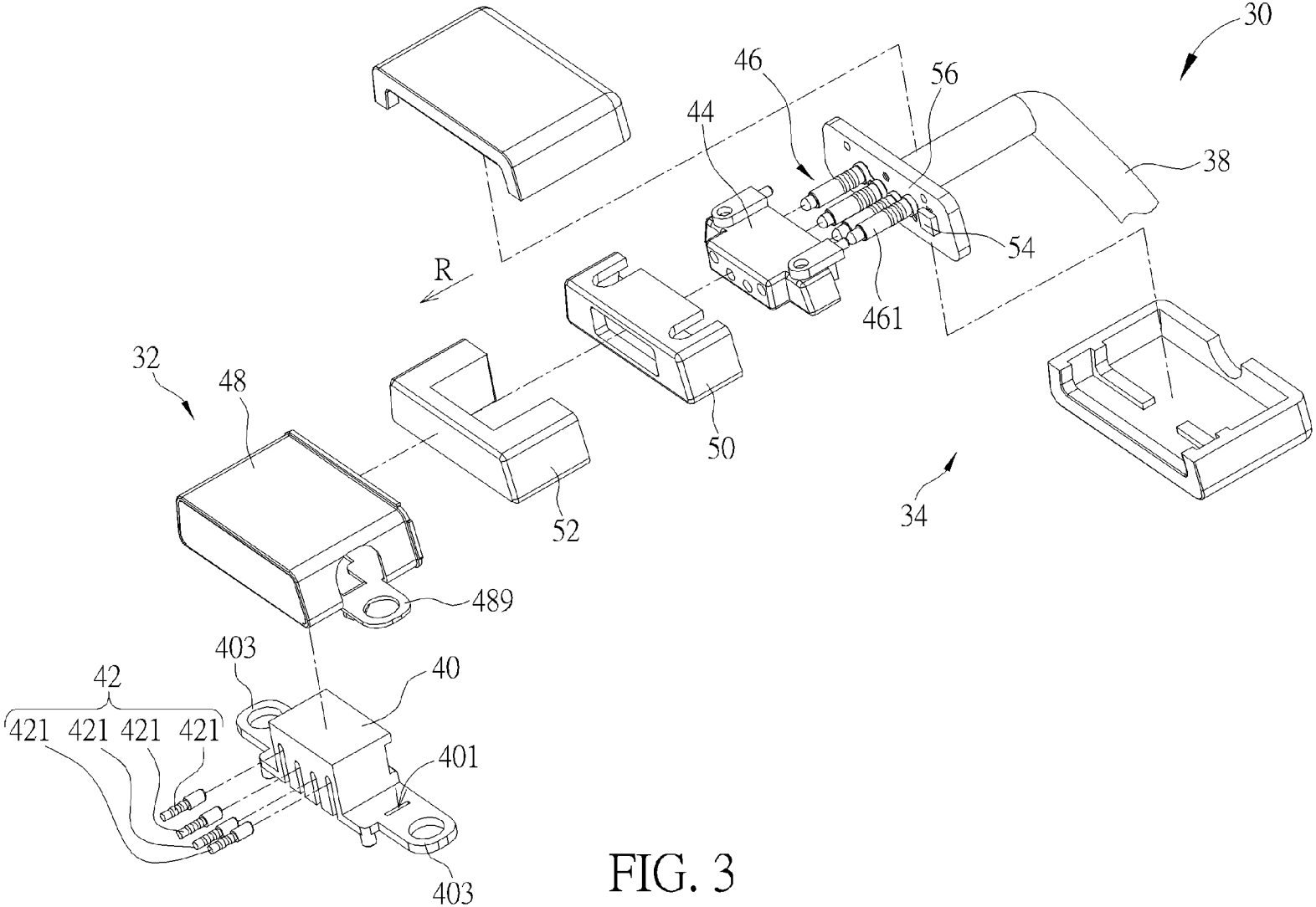
FIG. 3 is an exploded diagram of the connector assembly in another view according to the embodiment of the present invention.
Figure 4:
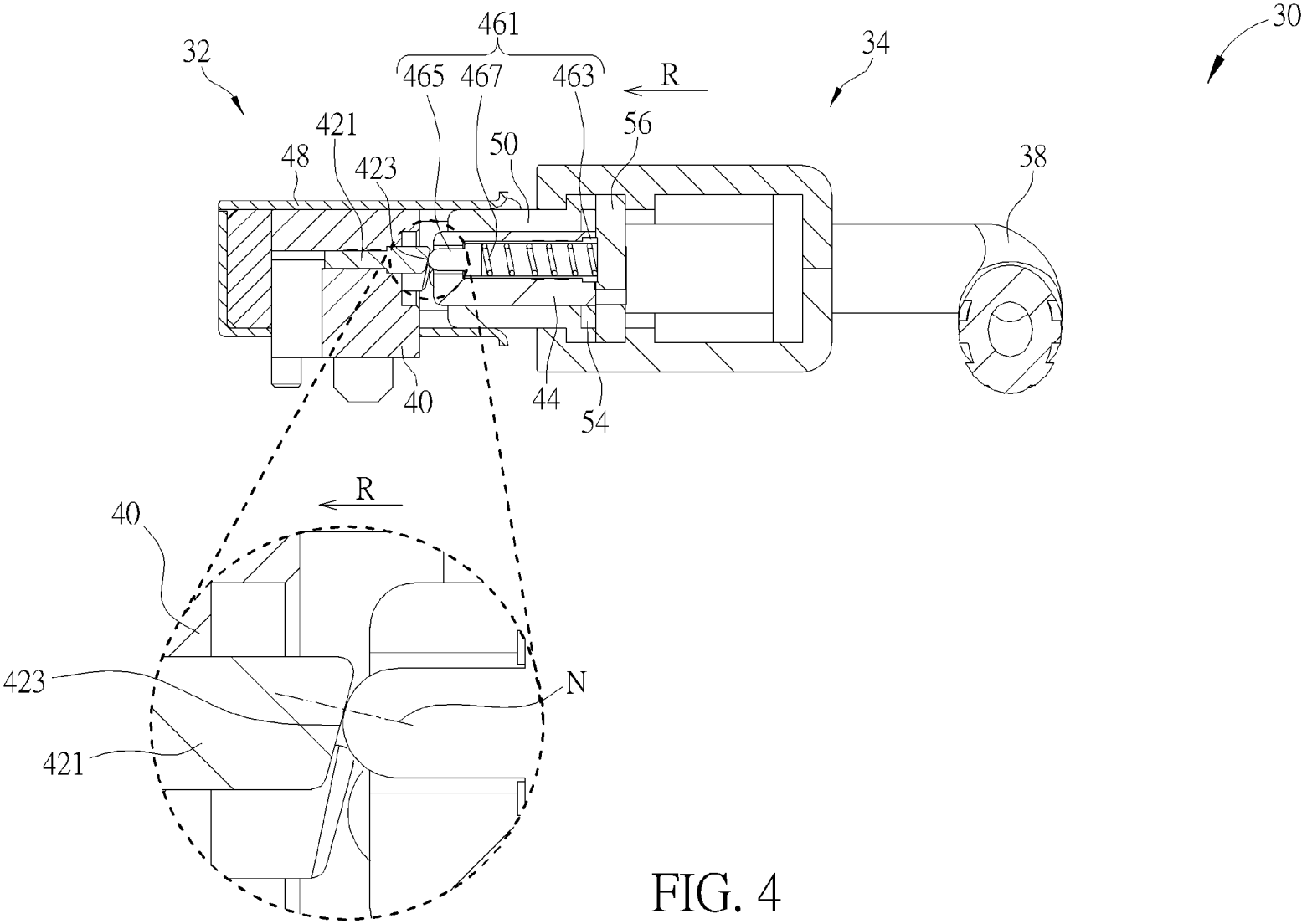
FIG. 4 is a sectional diagram of the connector assembly in a first mated status according to the embodiment of the present invention.
Figure 5:
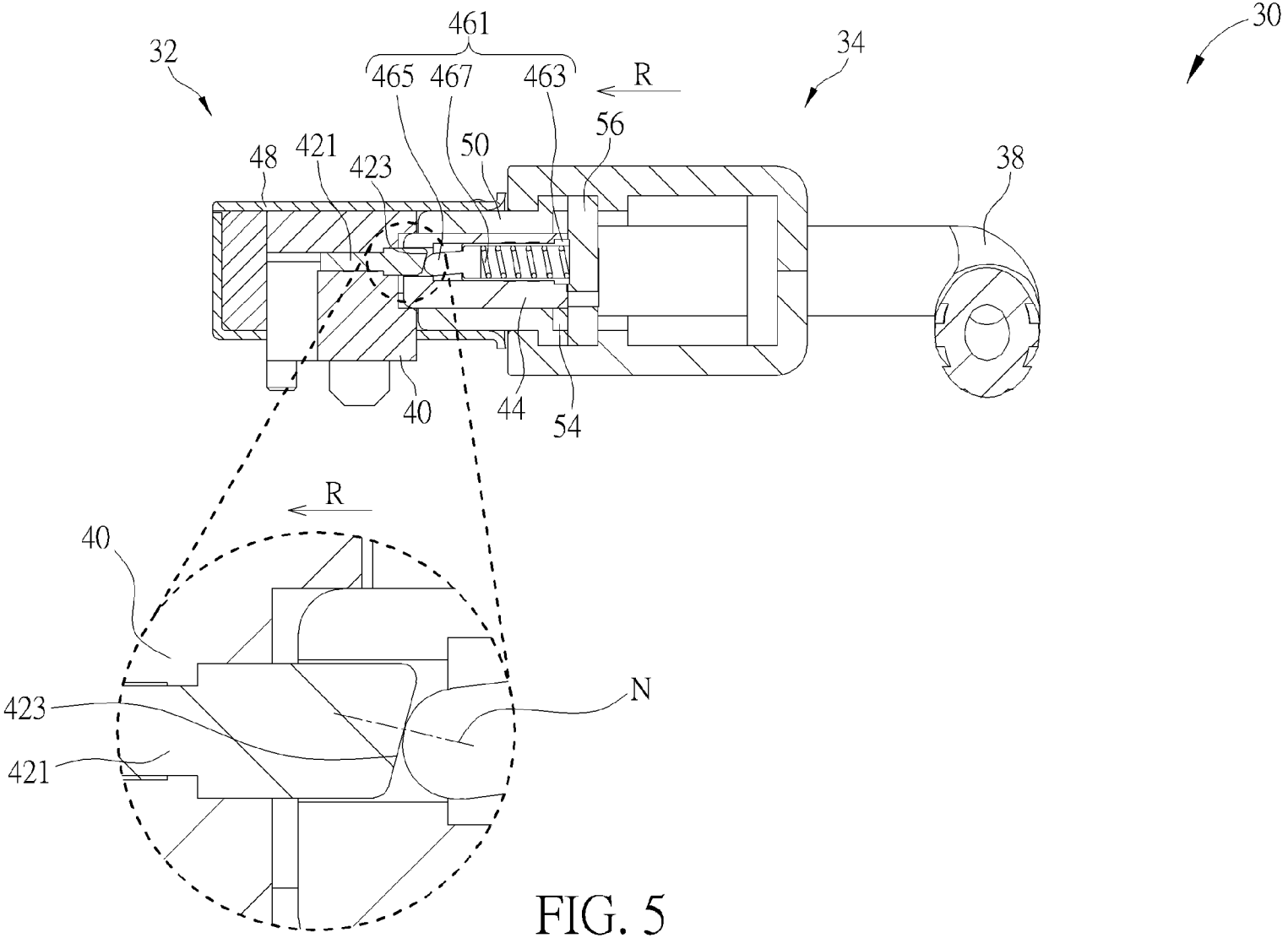
FIG. 5 is a sectional diagram of the connector assembly in a second mated status according to the embodiment of the present invention.

Please refer FIG. 1 to FIG. 5. FIG. 2 is an exploded diagram of the connector assembly 30 according to the embodiment of the present invention. FIG. 3 is an exploded diagram of the connector assembly 30 in another view according to the embodiment of the present invention. FIG. 4 is a sectional diagram of the connector assembly 30 in a first mated status according to the embodiment of the present invention. FIG. 5 is a sectional diagram of the connector assembly 30 in a second mated status according to the embodiment of the present invention. As shown in FIG. 1 to FIG. 5, the first connector 32 includes a first housing 40 and a first contact set 42. The first contact set 42 is fixed inside the first housing 40, and each of the first contacts 42 has a contacting surface 423. The second connector 34 includes a second housing 44 and a second contact set 46, and the second contact set 46 is fixed inside the second housing 44. When the second connector 34 is desired to be mated with the first connector 32, the second connector 34 is inserted into the first connector 32 along a mating direction R. In this embodiment, the contacting surface 423 of each of the first contacts 421 is an inclined surface, and a normal N of the inclined surface (i.e. the contacting surface 423) is not parallel to the mating direction R, as shown in FIG. 4 and FIG. 5.

In other words, in this embodiment, the contacting surface 423 of each of the first contacts 421 of the present invention adopts structure of the inclined surface for allowing an end of each of the second contacts 461 of the second contact set 46 to contact the contacting surface 423 of the corresponding first contact 421 when the second connector 34 is inserted into the first connector 32 along the mating direction R, such that the end of the second contact 461 slides along the contacting surface 423 from a first contact position shown in FIG. 4 to a second contact position shown in FIG. 5. Accordingly, the oxidation layers on the end of the second contact 461 and on the contacting surface 423 of the first contact 421 resulting from long term use will be scratched by the aforesaid sliding mechanism, so as to reduce resistance between the first contact 421 and the second contact 461. In such a manner, the structure of the inclined surface adopted by the contacting surface 423 of the first contact 421 of the present invention not only prevents the first contact 421 and the second contact 461 from being overheated due to a large resistance, but also prevents the first contact 421 and the second contact 461 from arcing due to overheat when the first contact 421 and the second contact 461 are electrified, so as to enhance safety of the first connector 32 and the second connector 34 in use.

In addition, the first connector 32 further includes a first shell member 48 covering the first housing 40, and the second connector 34 further includes a second shell member 50 covering the second housing 44. When the second connector 34 mates with the first connector 32, the first shell member 48 of the first connector 32 abuts against the second shell member 50 of the second connector 34, such that the first shell member 48 is electrically connected to the second shell member 50. Practically, the first shell member 48 is coupled to a ground end (not shown in figures) of the first electronic device 36. When the second connector 34 mates with the first connector 32, the first shell member 48 and the second shell member 50 conduct static electricity or noise on the second electronic device 38 to the ground end of the first electronic device 36. In other words, the first shell member 48 and the second shell member 50 can be utilized for shielding the first contact set 42 and the second contact set 46, such that the electromagnetic field generated by the first contact set 42 and the second contact set 46 as being transmitting high frequency signals does not affect other electronic components nearby the connector assembly 30. Furthermore, the first shell member 48 and the second shell member 50 can conduct the static electricity generated thereon to the ground, so as to prevent electromagnetic interference (EMI).

In this embodiment, each of the second contacts 461 of the second contact set 46 is a pogo pin. In other words, each of the second contacts 461 of the second contact set 46 includes a sleeve 463, a contact pin 465 and a resilient member 467. The sleeve 463 is fixed inside the second housing 44. The contact pin 465 is slidably disposed inside the sleeve 463. The resilient member 467 is disposed inside the sleeve 463 and abutting against the contact pin 465. When the second connector 34 mates with the first connector 32, as shown in FIG. 4 and FIG. 5, the resilient member 467 drives the contact pin 465 to contact the contacting surface 423 of the corresponding first contact 421 for electrically connecting the second connector 34 to the first connector 32. Structures of each of the second contacts 461 of the second contact set 46 are not limited to those mentioned in this embodiment. For example, each of the second contacts 461 of the second contact set 46 can be a spring-arm typed contact. As for which one of the above-mentioned designs is adopted, it depends on practical demands.

As shown in FIG. 1 to FIG. 5, the first connector 32 further includes a magnetic member 52 installed inside the first housing 40 and for generating magnetic field. The second connector 34 further includes a magnetic sensor 54 disposed inside the second housing 44 in a position where magnetic field line of the magnetic member 52 passes. Furthermore, the connector assembly 30 further includes a control unit 56 coupled to the magnetic sensor 54. When the second connector 34 is inserted into the first connector 32 along the mating direction R, the magnetic sensor 54 is moved by the second connector 34 for approaching the magnetic member 52 inside the first connector 32. When the magnetic sensor 54 enough approaches the magnetic member 52 (e.g. when the second connector 34 is completely inserted into the first connector 32, i.e the second connector 34 and the first connector 32 are in the second mated status shown in FIG. 5), the magnetic sensor 54 senses magnetic field generated by the magnetic member 52 and outputs a control signal to the control unit 56. Meanwhile, the control unit 56 controls the second electronic device 38 to power the first electronic device 36 according to the control signal. In such a manner, when the second connector 34 is not inserted into the first connector 32, the magnetic sensor 54 does not sense the magnetic field generated by the magnetic member 52. Meanwhile, the control unit 56 controls the second electronic device 38 not to power the first electronic device 36. On the other hand, when the second connector 34 is inserted into the first connector 32 (i.e. when the second connector 34 and the first connector 32 are in the second mated status), the magnetic sensor 54 senses the magnetic field generated by the magnetic member 52, such that the control unit 56 controls the second electronic device 38 to power the first electronic device 36.

As mentioned above, the present invention utilizes the control unit 56 for driving the second electronic device 38 to power the first electronic device 36 when the magnetic sensor 54 senses the magnetic field generated by the magnetic member 52, so as to confirm that current passes between the end of the second contact 461 and the contacting surface 423 of the first contact 421 only when the end of the second contact 461 slides along the contacting surface 423 of the first contact 421 from the first contact position shown in FIG. 4 to the second contact position shown in FIG. 5. In such a manner, the present invention ensures that there will be no current passing between the end of the second contact 461 and the contacting surface 423 of the first contact 421 before the oxidation on the end of the second contact 461 and on the contacting surface 423 of the first contact 421 due to long term use is not scratched. Furthermore, it prevents the first contact 421 and the second contact 461 from being overheated due to the large resistance, so as to prevent the first contact 421 and the second contact 461 from arcing as being electrified and to enhance the safety of the first connector 32 and the second connector 34 in use.

In this embodiment, the magnetic sensor 54 is a Hall sensor, and the control unit 56 is a circuit board connected to the second housing 44. Structures of the control unit 56 are not limited to those mentioned in this embodiment. For example, the control unit 56 can be a chip disposed inside an external electronic device, such as an adapter. As for which one of the above-mentioned designs is adopted, it depends on practical demands. Practically, the second shell member 50 of the second connector 34 is made of magnetic material, such as steel, and the magnetic member 52 is a magnet. In such a manner, the magnetic member 52 is capable of attracting the second shell member 50 when the second connector 34 is mated with the first connector 32, so as to fix the first connector 32 and the second connector 34.

Figure 6:
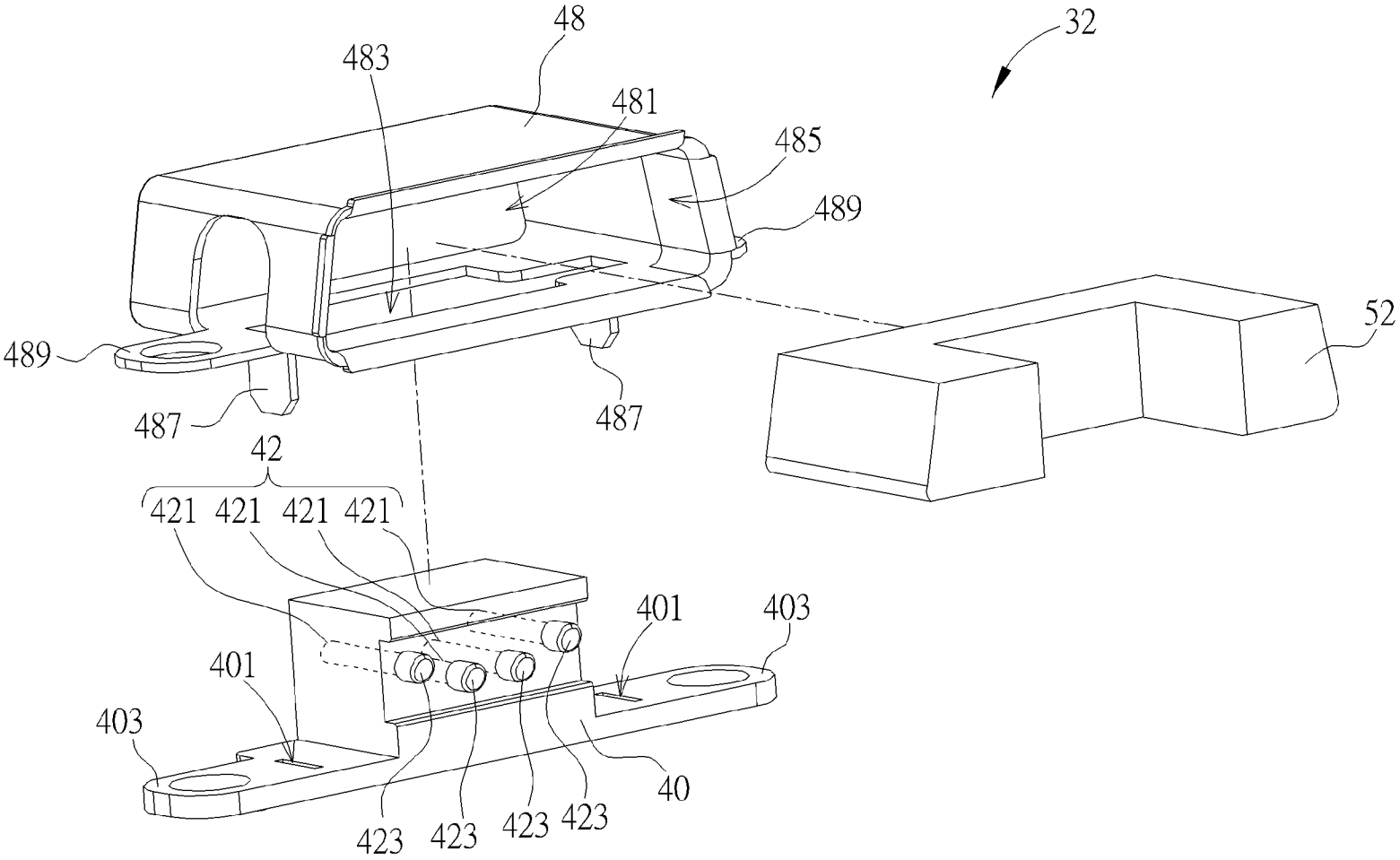
FIG. 6 is an exploded diagram of a first connector in another view according to the embodiment of the present invention.
Figure 7:
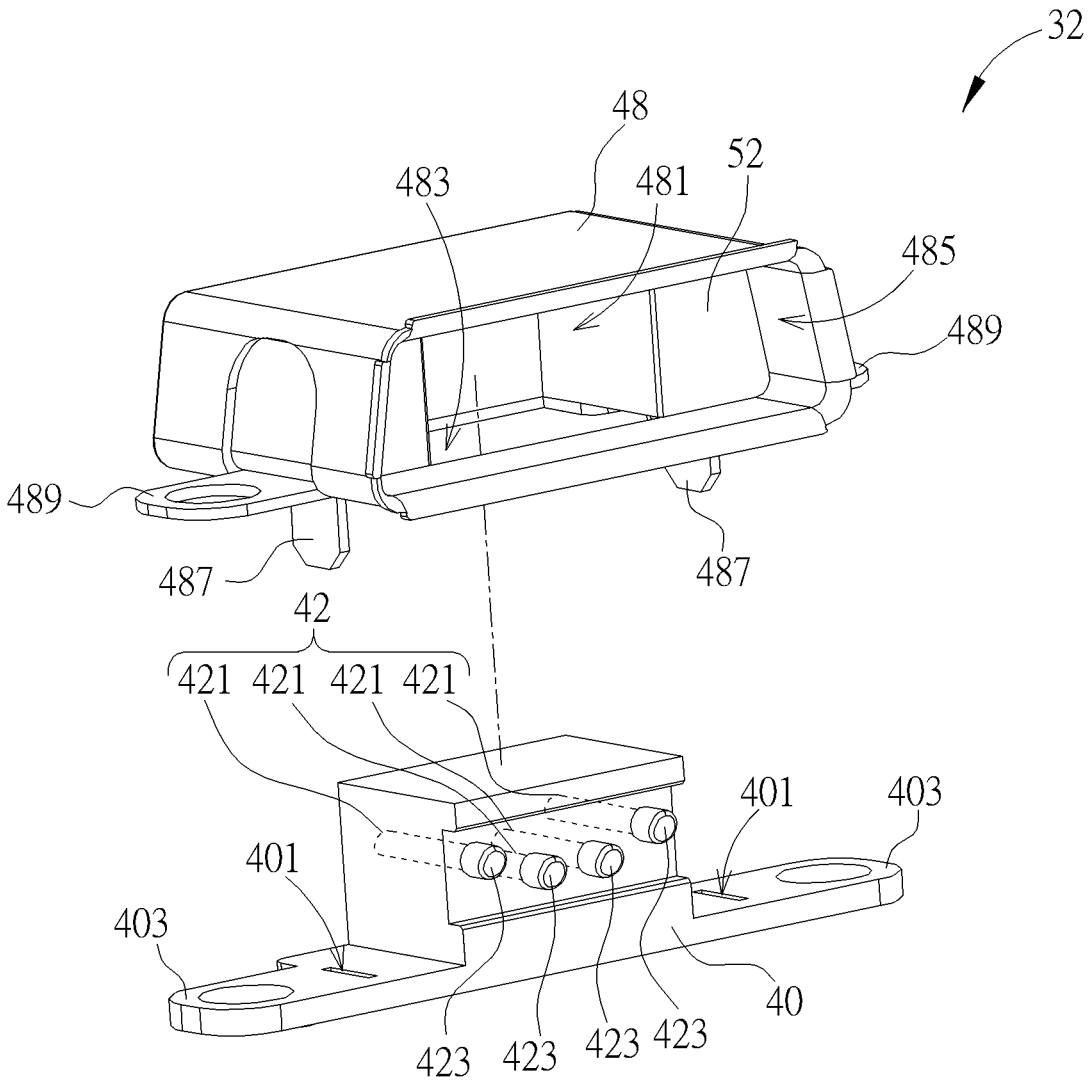
FIG. 7 and FIG. 8 are respectively diagrams of the first connector in different assembled statuses according to the embodiment of the present invention.
Figure 8:
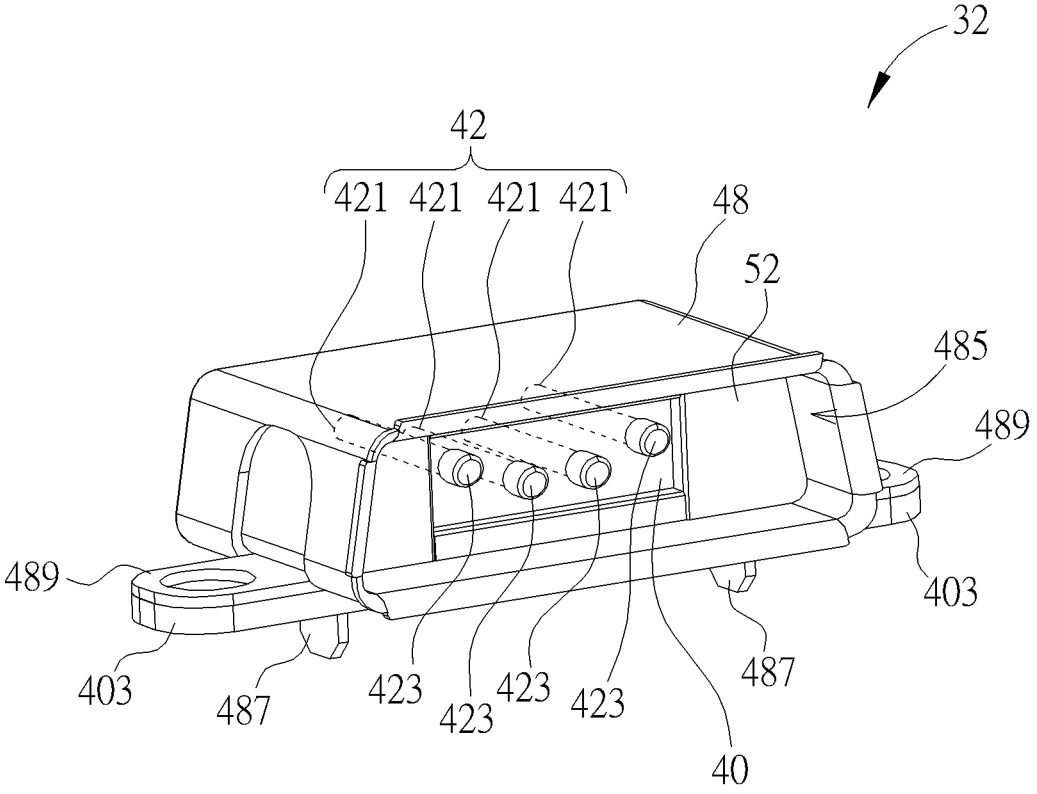

Please refer to FIG. 6 to FIG. 8. FIG. 6 is an exploded diagram of the first connector 32 in another view according to the embodiment of the present invention. FIG. 7 and FIG. 8 are respectively diagrams of the first connector 32 in different assembled statuses according to the embodiment of the present invention. As shown in FIG. 6 to FIG. 8, a containing space 481, an assembly opening 483, a mating opening 485, at least one fixing post 487 and at least one shell fixing lug 489 are formed on the first shell member 48 of the first connector 32. The mating opening 485 and the assembly opening 483 respectively communicate with the containing space 481, and the second connector 34 is detachably mated with the first connector 32 via the mating opening 485. Furthermore, at least one fixing hole 401 and at least one housing fixing lug 403 are formed on the first housing 40 of the first connector 32, and the at least one fixing hole 401 corresponds to the at least one fixing post 487.

When the first connector 32 is assembled, the magnetic member 52 is assembled into the containing space 481 via the mating opening 485, as shown in FIG. 7. Then, the first housing 40 is installed inside the containing space 481 via the assembly opening 483, as shown in FIG. 8. When the first housing 40 is installed inside the containing space 481 via the assembly opening 483, the at least one fixing post 487 is used for inserting into the at least one fixing hole 401 on the first housing 40 in a tight fit manner, so as to fix the first housing 40 inside the containing space 481. In this embodiment, there are two fixing posts 487 formed on the first shell member 48 and two fixing holes 401 formed on the first housing 40, correspondingly. Amounts of the fixing post 487 and the fixing hole 401 are not limited to those mentioned in this embodiment, and it depends on practical demands. After assembly of the first connector 32 is completed, a fixing component (e.g. a screw) passes through the shell fixing lug 489 and the housing fixing lug 403 for fixing the first connector 32 inside the first electronic device 36. In other words, the shell fixing lug 489 is used for fixing the first shell member 48 inside the first electronic device 36, and the housing fixing lug 403 is used for fixing the first housing 40 inside the first electronic device 36.

Figure 9:
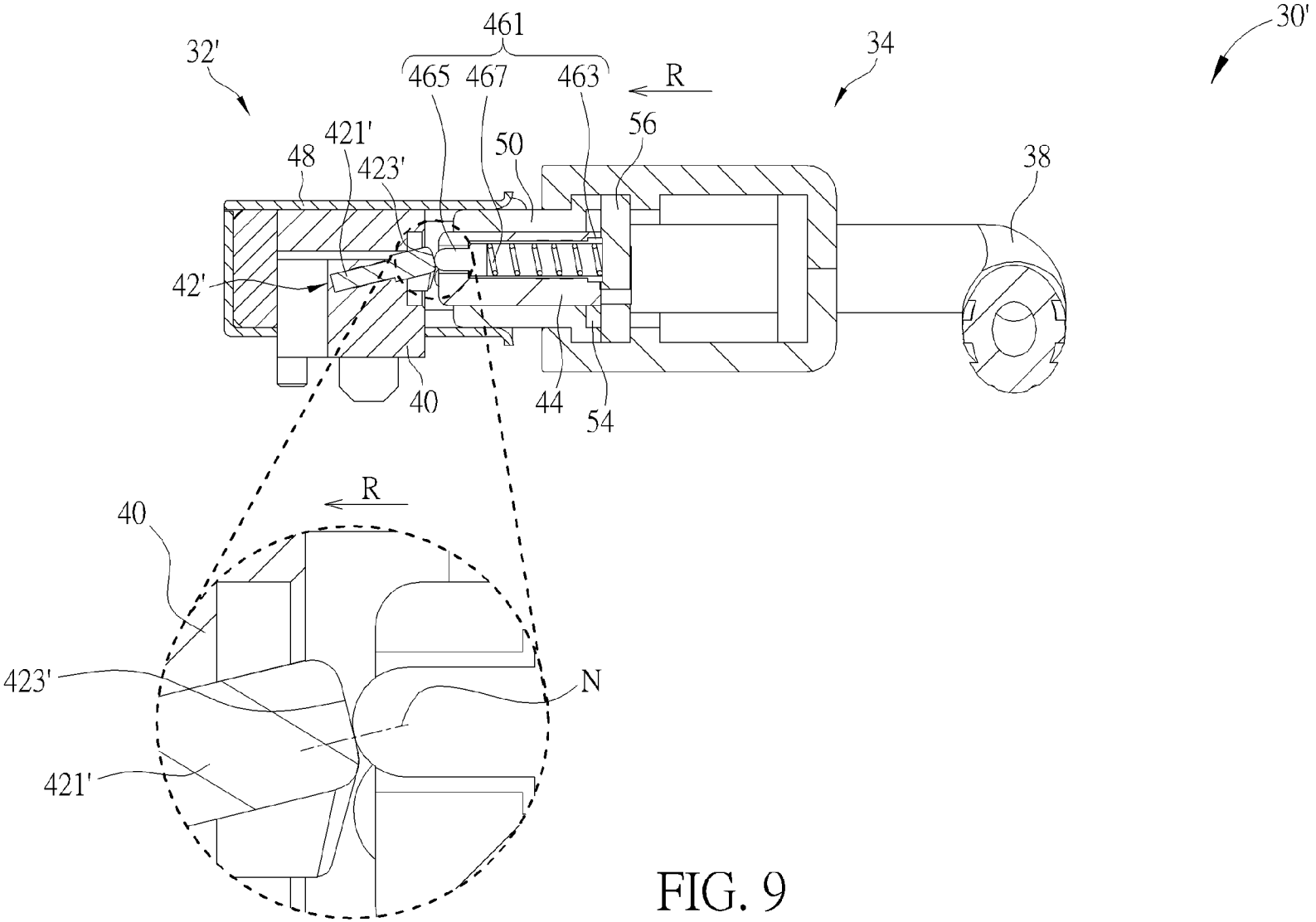
FIG. 9 is a partly sectional diagram of a connector assembly in a first mated status according to another embodiment of the present invention.
Figure 10:
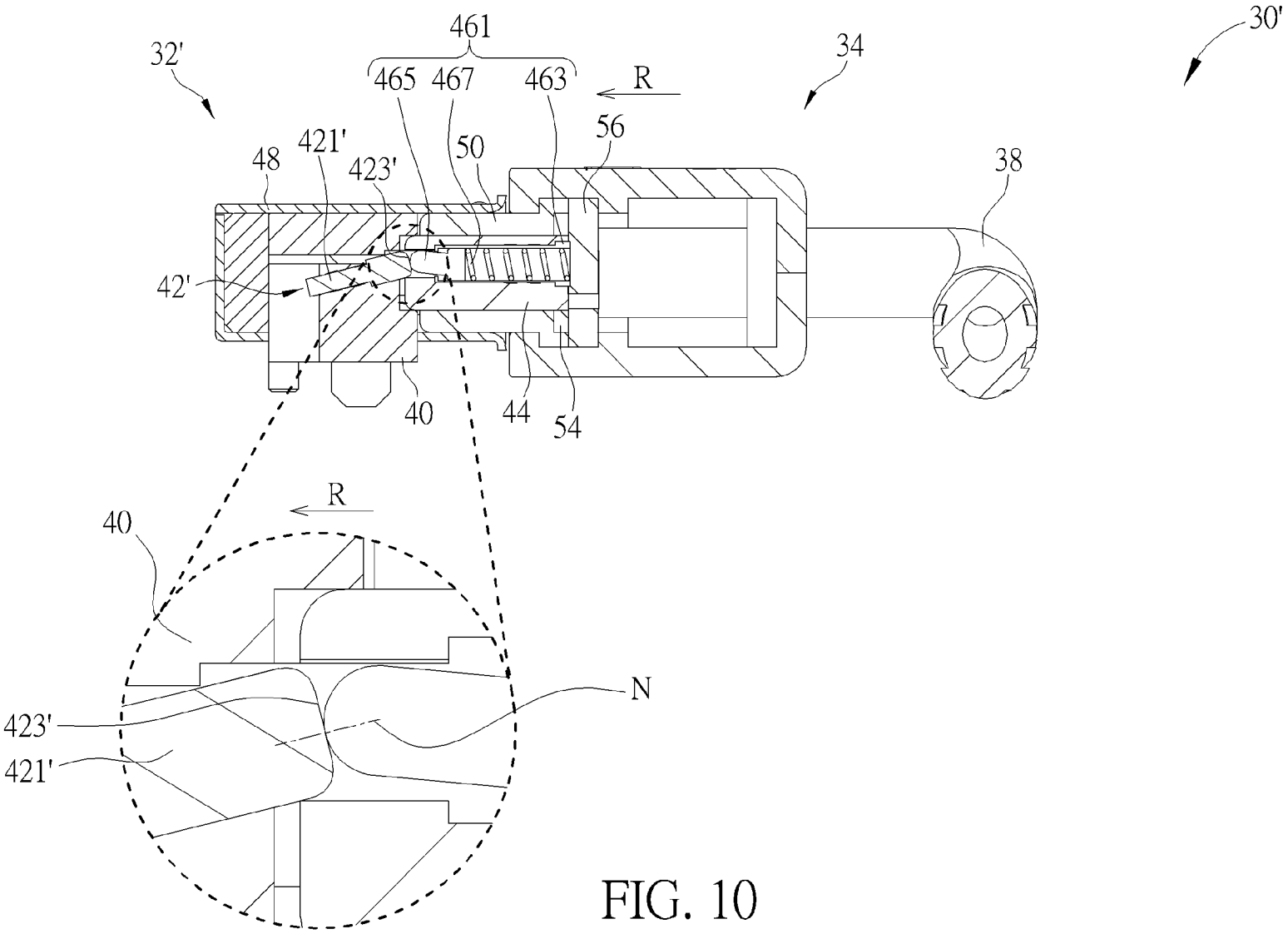
FIG. 10 is a partly sectional diagram of the connector assembly in a second mated status according to another embodiment of the present invention.

Please refer to FIG. 9 and FIG. 10. FIG. 9 is a partly sectional diagram of a connector assembly 30' in a first mated status according to another embodiment of the present invention. FIG. 10 is a partly sectional diagram of the connector assembly 30' in a second mated status according to another embodiment of the present invention. As shown in FIG. 9 and FIG. 10, the main difference between the connector assembly 30' and the aforesaid connector assembly 30 is that a contacting surface 423' of a first contact 421' of the connector assembly 30' is a flat surface, and a first contact set 42' is fixed inside the first housing 40 and oriented by a normal N' of the contacting surface 423' of the first contact set 42' not parallel to the mating direction R. When the second connector 34 in inserted into a first connector 32' along the mating direction R, an end of each of the second contacts 461 of the second contact set 46 contacts the contacting surface 423' of the corresponding first contact 421', such that the end of the second contacts 461 slides along the contacting surface 423' from a first contact position shown in FIG. 9 to a second contact position shown in FIG. 10. Accordingly, the oxidation layers on the end of the second contact 461 and on the contacting surface 423' of the first contact 421' resulting from long term use will be scratched by the aforesaid sliding mechanism, so as to reduce resistance between the first contact 421' and the second contact 461. Components with denoted in this embodiment identical to those in the aforesaid embodiment have identical structures and functions, and further description is omitted herein for simplicity.

Figure 11:
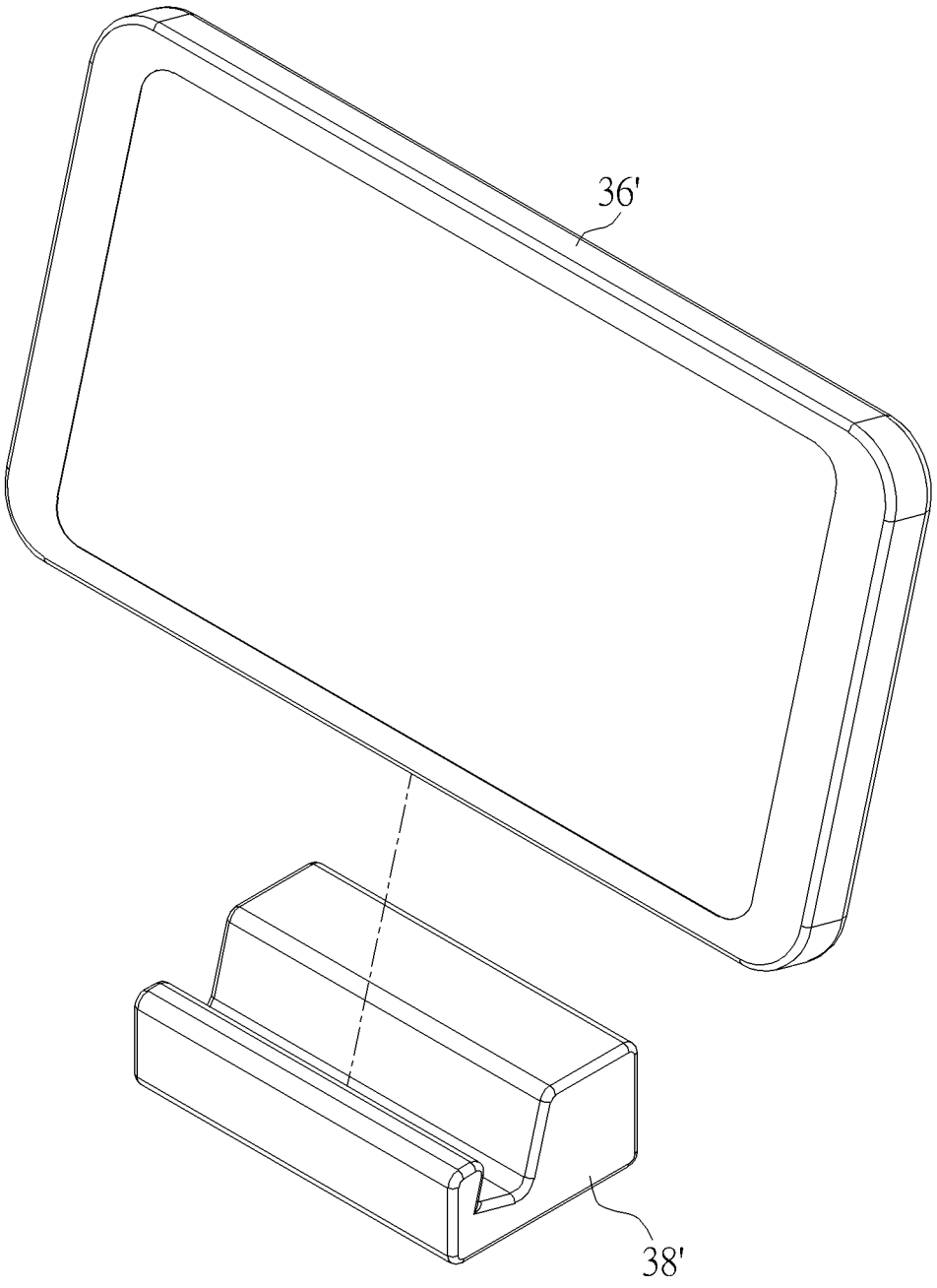
FIG. 11 is an exploded diagram illustrating the connector assembly is implemented in another first electronic device and another second electronic device according to the embodiment of the present invention.
Figure 12:
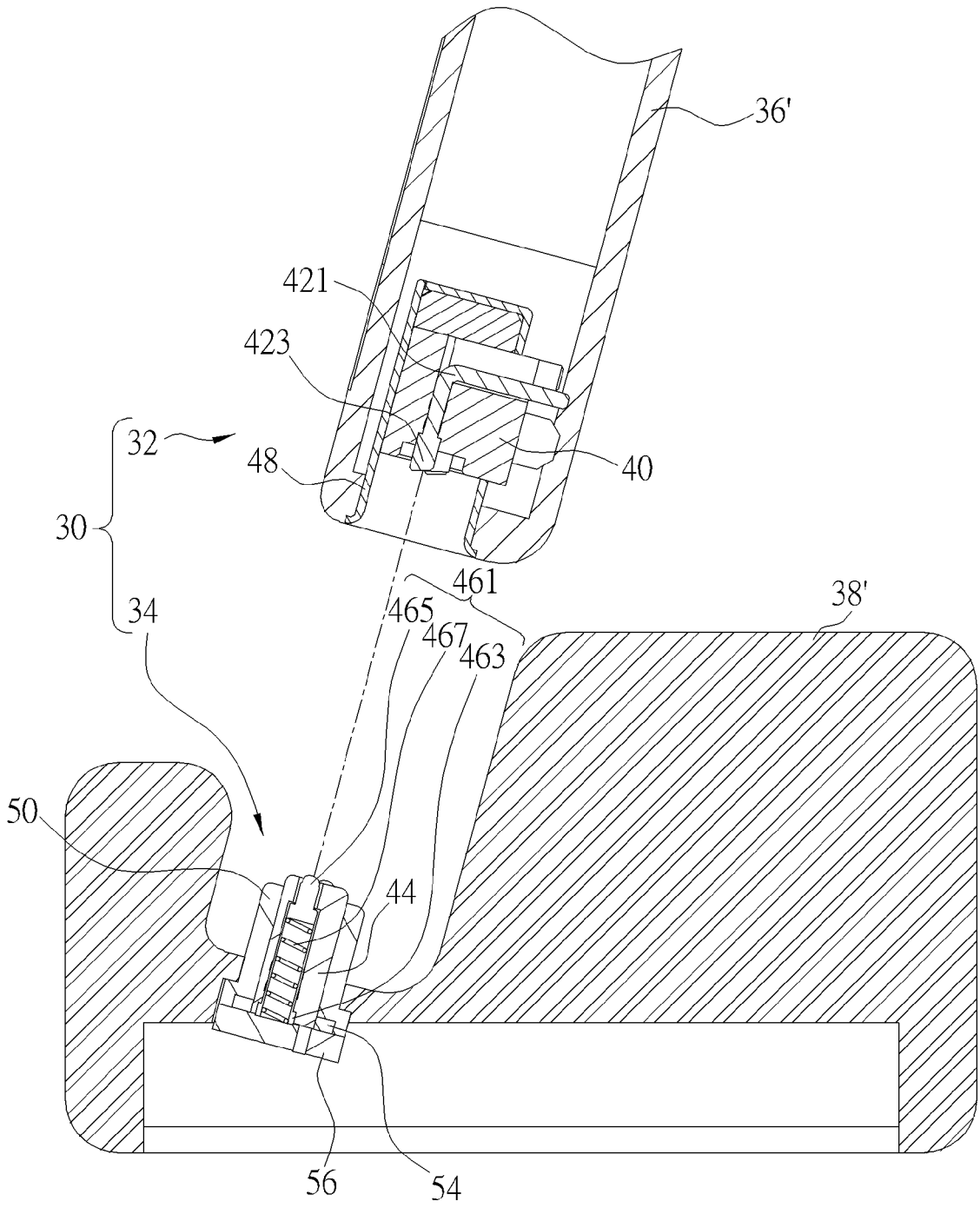
FIG. 12 is an exploded sectional diagram illustrating the connector assembly is implemented in the first electronic device and the second electronic device according to the embodiment of the present invention.
Figure 13:
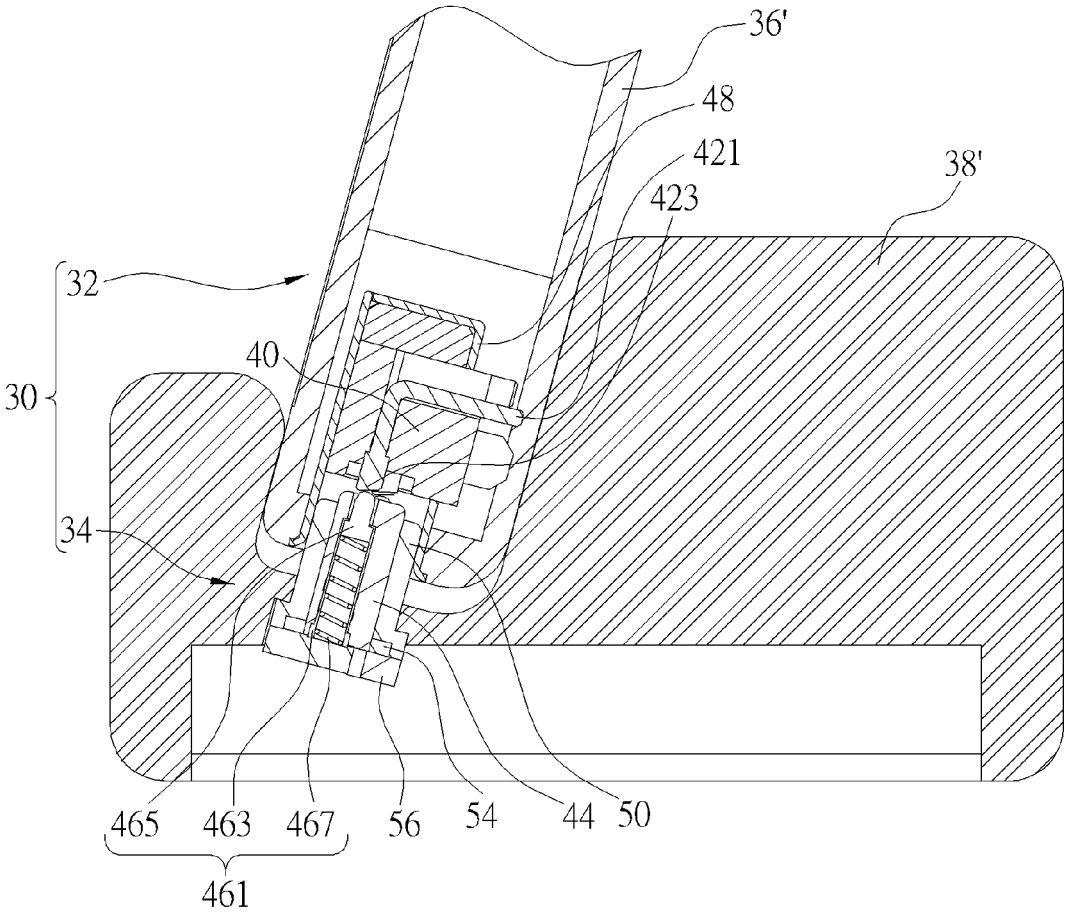
FIG. 13 is a diagram of the connector assembly illustrating the first electronic device is inserted into the second electronic device according to the embodiment of the present invention.

Please refer to FIG. 11 to FIG. 13. FIG. 11 is an exploded diagram illustrating the connector assembly 30 is implemented in another first electronic device 36' and another second electronic device 38' according to the embodiment of the present invention. FIG. 12 is an exploded sectional diagram illustrating the connector assembly 30 is implemented in the first electronic device 36' and the second electronic device 38' according to the embodiment of the present invention. FIG. 13 is a diagram of the connector assembly 30 illustrating the first electronic device 36' is inserted into the second electronic device 38' according to the embodiment of the present invention. As shown in FIG. 11 to FIG. 13, the first connector 32 of the connector assembly 30 can be coupled to the other first electronic device 36', and the second connector 34 of the connector assembly 30 can be coupled to the other second electronic device 38'. In this embodiment, the first electronic device 36' is a portable electronic device, e.g. a cell phone, and the second electronic device 38' is a docking base. Furthermore, the connector assembly 30 can be used for allowing the docking base to be electrically connected to the portable electronic device, such that the docking base electrifies the portable electronic device. In other words, the connector assembly 30 of the present invention can be implemented into the portable electronic device and the docking base as well. Furthermore, implementation of the first electronic device 36' is not limited to those mentioned in this embodiment. For example, the first electronic device 36' can be a tablet computer or a personal digital assistant (PDA) as well. Components with denoted in this embodiment identical to those in the aforesaid embodiment have identical structures and functions, and further description is omitted herein for simplicity.

Compared to the prior art, the present invention adopts a design that the normal of the contacting surface of each of the first contacts is not parallel to the mating direction to allow the end of each of the second contacts of the second contact set to contact the contacting surface of the corresponding first contact when the second connector is inserted into the first connector along the mating direction, such that the end of the second contact slides from the first contact position to the second contact position. Accordingly, the oxidation layers on the end of the second contact and on the contacting surface of the first contact resulting from long term use will be scratched by the aforesaid sliding mechanism, so as to reduce resistance between the first contact and the second contact. In such a manner, the structure of the inclined surface adopted by the contacting surface of the first contact of the present invention not only prevents the first contact and the second contact from being overheated due to a large resistance, but also prevents the first contact and the second contact from arcing due to overheat when the first contact and the second contact are electrified, so as to enhance safety of the first connector and the second connector in use.

In addition, the present invention utilizes the control unit for driving the second electronic device to power the first electronic device when the magnetic sensor senses the magnetic field generated by the magnetic member, so as to confirm that current passes between the end of the second contact and the contacting surface of the first contact only when the end of the second contact slides along the contacting surface of the first contact from the first contact position to the second contact position. In such a manner, the present invention ensures that there will be no current passing between the end of the second contact and the contacting surface of the first contact before the oxidation on the end of the second contact and on the contacting surface of the first contact due to long term use is not scratched. Furthermore, it prevents the first contact and the second contact from being overheated due to the large resistance, as being electrified and to enhance the safety of the first connector and the second connector in use.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A connector assembly, comprising:

a first connector coupled to a first electronic device, comprising:

a first housing; and a magnetic member installed inside the first housing and for generating magnetic field; and a second connector coupled to a second electronic device and detachably mated with the first connector, the second connector comprising:

a second housing; and a magnetic sensor disposed in the second housing, the magnetic sensor sensing the magnetic field generated by the magnetic member when the second connector mates with the first connector, so as to drive the second electronic device to power the first electronic device a control unit coupled to the magnetic sensor, the control unit controlling the second electronic device to power the first electronic device when the magnetic sensor senses the magnetic field generated by the magnetic member, wherein the control unit is a circuit board connected to the second housing.

2. The connector assembly of claim 1, wherein the magnetic sensor is a Hall sensor.

3. The connector assembly of claim 1, wherein the first connector further comprises a first shell member covering the first housing, and the second connector further comprises:

a second shell member covering the second housing, the magnetic member attracting the second shell member, such that the second connector mates with the first connector, wherein the first shell member abuts against the second shell member when the second connector mates with the first connector, such that the first shell member is electrically connected to the second shell member.

4. The connector assembly of claim 3, wherein a containing space, an assembly opening, a mating opening are formed on the first shell member, the mating opening and the assembly opening respectively communicate with the containing space, the first housing is installed inside the containing space via the assembly opening, and the second connector is detachably mated with the first connector via the mating opening.

5. The connector assembly of claim 4, wherein at least one fixing post is further formed on the first shell member, at least one fixing hole is formed on the first housing in a position corresponding to the at least one fixing post, and the at least one fixing post is for inserting into the at least one fixing hole on the first housing in a tight fit manner when the first housing is installed inside the containing space via the assembly opening, so as to fix the first housing inside the containing space.

6. The connector assembly of claim 3, wherein the second shell member is made of magnetic material.

7. The connector assembly of claim 3, wherein at least one shell fixing lug is formed on the first shell member for fixing the first shell member inside the first electronic device.

8. The connector assembly of claim 1, wherein at least one housing fixing lug is formed on the first housing for fixing the first housing inside the first electronic device.

9. The connector assembly of claim 1, wherein the first connector further comprises a first contact set fixed inside the first housing, each of the first contacts has a contacting surface, a normal of the contacting surface is not parallel to a mating direction, and the second connector further comprises:

a second contact set fixed inside the second housing, an end of each of the second contacts contacting the contacting surface of the corresponding first contact and sliding along the contacting surface from a first contact position to a second contact position when the second connector mates with the first connector along the mating direction.

10. The connector assembly of claim 9, wherein the contacting surface is an inclined surface, and the normal of the inclined surface is not parallel to the mating direction.

11. The connector assembly of claim 9, wherein the contacting surface is a flat surface, and the first contact set is fixed inside the first housing and oriented by the normal of the flat surface not parallel to the mating direction.

12. The connector assembly of claim 1, wherein the magnetic sensor is disposed inside the second housing and located in a position where magnetic line of force of the magnetic member passes.

13. The connector assembly of claim 1, wherein the first electronic device is a portable electronic device, and the second electronic device is a cable or a docking base.

14. A connector assembly, comprising:

a first connector coupled to a first electronic device, comprising:

a first housing;

a first contact set fixed inside the first housing, each of the first contacts has a contacting surface; and a first shell member covering the first housing; and a second connector coupled to a second electronic device and detachably mated with the first connector along a mating direction, a normal of the contacting surface being not parallel to the mating direction, the second connector comprising:

a second housing;

a second contact set fixed inside the second housing, an end of each of the second contacts contacting the contacting surface of the corresponding first contact and sliding along the contacting surface from a first contact position to a second contact position when the second connector mates with the first connector along the mating direction; and a second shell member covering the second housing, the magnetic member attracting the second shell member, such that the second connector mates with the first connector, wherein the first shell member abuts against the second shell member when the second connector mates with the first connector, such that the first shell member is electrically connected to the second shell member.

15. The connector assembly of claim 14, wherein the contacting surface is an inclined surface, and the normal of the inclined surface is not parallel to the mating direction.

16. The connector assembly of claim 14, wherein the contacting surface is a flat surface, and the first contact set is fixed inside the first housing and oriented by the normal of the flat surface not parallel to the mating direction.

17. The connector assembly of claim 14, wherein each of the second contacts comprises:

a sleeve fixed inside the second housing;

a contact pin slidably disposed inside the sleeve; and a resilient member disposed inside the sleeve and abutting against the contact pin, the resilient member driving the contact pin to contact the contacting surface of the corresponding first contact.

* * * * *